US005317792A

United States Patent [19]

Tanaka

[11] Patent Number: 5,317,792

[45] Date of Patent: Jun. 7, 1994

[54] METHOD OF MANUFACTURING PIEZOELECTRIC RESONATOR

[75] Inventor: Yasuhiro Tanaka, Nagaokakyo, Japan

[73] Assignee: Murata Manufacturing Co., Ltd., Japan

[21] Appl. No.: 792,167

[22] Filed: Nov. 14, 1991

[30] Foreign Application Priority Data

Nov. 17, 1990 [JP] Japan ..... 2-312552

[51] Int. Cl.[5] ..... H04R 17/00

[52] U.S. Cl. ..... 29/25.35; 29/411

[58] Field of Search ..... 29/25.35, 411, 25.41; 310/320, 340, 344

[56] References Cited

U.S. PATENT DOCUMENTS 3,613,228 10/1971 Cook et al. ..... 29/411

4,293,986 10/1981 Kobayashi et al. ..... 310/344

4,564,980 1/1986 Diepers ..... 29/25.35

4,652,787 3/1987 Zingg ..... 310/344

*Primary Examiner*—P. W. Echols

*Attorney, Agent, or Firm*—Ostrolenk, Faber, Gerb & Soffen

[57] ABSTRACT

A method of manufacturing a piezoelectoric resonator includes the steps of alternately layering piezoelectric device substrates and first sealing substrates to form a block-shaped layered element, and then cutting the same to provide a piezoelectric resonator element, so that a number of the resonator elements for forming piezoelectric resonators can be prepared simultaneously through laminating, adhering and cutting processes. Hence, it reduces the number of steps thereby facilitating mass-productivity and reducing the cost to produce a chip-type piezoelectric resonator.

11 Claims, 2 Drawing Sheets

METHOD OF MANUFACTURING PIEZOELECTRIC RESONATOR

BACKGROUND OF THE INVENTION

1. Field of the Invention

The invention relates to a method of manufacturing a chip type piezoelectric resonator for use in a piezoelectric filter, an oscillator or the like.

2. Description of the Prior Art

There has been proposed a chip type piezoelectric resonator constructed as in FIG. 3 and a method of manufacturing the same effectively.

In FIG. 3, 1 shows a piezoelectric resonator which comprises a piezoelectric device 5A which includes a piezoelectric substrate 2 provided on both of its sides with a plurality of vibrating electrodes 3 and input/output electrodes 4, respectively. Layers each comprising a first sealing substrate 6 are placed over and adhered to both sides (top and bottom) of the piezoelectric device 5A followed by forming a pair of outside electrodes 7 each electrically communicating with the input/output electrodes 4. Further a second sealing substrate 8 is adhered to both exposed lateral side surfaces (front and back) of the piezoelectric device 5A thereby sealing both of its lateral sides.

The vibrating electrodes 3 are located in a vibration cavity 9 to prevent vibration from being damped, and the vibration cavity 9 is sealed at both ends by an adhesive 10. Each vibration cavity 9 is a gap which is defined between the piezoelectric substrate 2 and the first sealing substrate 6. The gap's height is equal to the thickness of the coated adhesive 10.

The method of manufacturing the above piezoelectric resonator 1 will be detailed with reference to FIGS. 1A, 4A and 4B.

A piezoelectric device 5A constituting a principal portion of the piezoelectric resonator 1 is made, as shown in FIG. 4A, by providing the piezoelectric substrate 2 made of piezoelectric ceramics or the like on both its sides with the electrodes 3 and 4 by sputtering, vacuum deposition, or printing and baking of conductive paste, or the like. A plurality of piezoelectric devices 5A (see FIG. 1A) are comprised in the piezoelectric device substrate 5. The opposing (overlapping) portions of the electrodes in the piezoelectric devices 5A at the top and bottom sides of the piezoelectric device substrate 5 (as seen in the figures) form the vibrating electrodes 3, and the remaining end parts of the piezoelectric devices 5A which are not overlapping with each other form the input/output electrodes 4. The first sealing substrate 6 made of ceramics is placed on and adhered to both side surfaces of the piezoelectric device substrate 5 to form the vibration cavity 9 along each vibrating electrode 3 of the piezoelectric device substrate 5 comprising the plurality of piezoelectric device 5A, thereby forming a substrate-layered member 11. The substrate-layered member 11 is cut along the lines C—C and D—D in FIG. 4B to obtain an individual resonator element 12. The outside electrodes 7 are formed at both lateral ends of the resonator element 12 so as to electrically communicate with the input/output electrodes 4 which extend to those ends. Also, the second sealing substrates 8 are adhered to both lateral side surfaces of the resonator element 12 to seal the vibration cavity 9 and thereby form the piezoelectric resonator 1 of FIG. 3.

SUMMARY OF THE INVENTION

A primary object of the present invention is to provide a method of manufacturing a piezoelectric resonator which enables an effective preparation of a chip type piezoelectric resonator.

Another object of the present invention is to provide a method of manufacturing a piezoelectric resonator to facilitate work efficiency, mass-productivity and cost reduction for manufacturing a chip type piezoelectric resonator.

To achieve the objects above, according to the invention, a method of manufacturing a piezoelectric resonator is provided. This invention involves the following steps:

- to first laminate and adhere a piezoelectric device substrate, which provided with a plurality of vibrating electrodes and input/output electrodes, at one side surface of the device substrate, to a first sealing substrate so as to form a vibration cavity on the vibrating electrode surfaces;
- to then laminate and adhere the first sealing substrate to the other side of the piezoelectric device substrate to form a vibration cavity on vibrating electrodes thereat, and alternately laminating and adhering to each other the piezoelectric device substrates and the first sealing substrates to form a block-like shaped layered element;
- to then cut the block-like shaped layered element including a number of resonator elements at a predetermined point to obtain a number of resonator elements, thereby forming a substrate-layered element having a number of resonator elements;
- to then cut the substrate-layered element at a predetermined point so as to provide a single resonator element;
- to adhere a second sealing substrate to both lateral side surfaces of the substrate-layered element or the single resonator element; and
- to form outside electrodes, which electrically communicate with the input/output electrodes, at both end surfaces of the substrate-layered element or the individual resonator element to obtain a piezoelectric resonator.

The manufacturing method according to the present invention layers alternately the piezoelectric device substrates and the first sealing substrates to form the block-shaped layered element, and cuts the same to provide a piezoelectric resonator, so that a number of the resonator elements for forming the piezoelectric resonator can be prepared in a lump through laminating, adhering and cutting processes. Hence, it requires merely less number of repetition of the series of processes, thereby facilitating mass-productivity and reducing cost to produce.

DESCRIPTION OF THE PREFERRED EMBODIMENTS

An example of the present invention will be detailed with reference to the accompanied drawings. The same reference numbers are used for the elements corresponding to those of the conventional example.

Figure 1A:
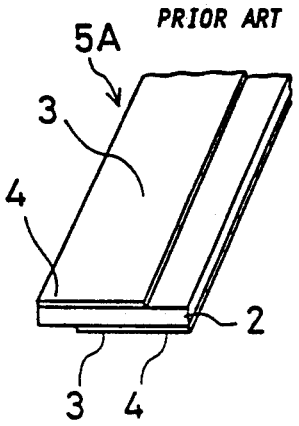
FIG. 1A PRIOR ART
FIG. 1A is a fragmentary perspective view of a piezoelectric device constituting a portion of the known piezoelectric resonator of FIG. 3.
Figure 1B:
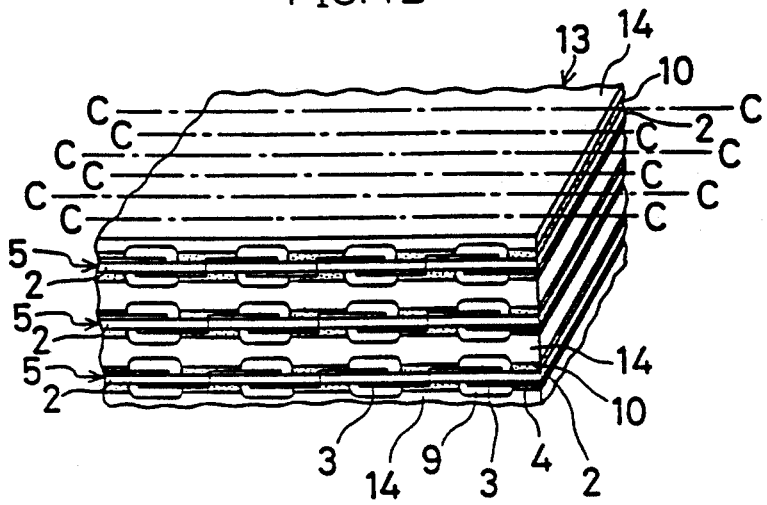
FIGS. 1B and 1C are perspective views showing the manufacturing process performed in one example of the manufacturing method according to the present invention.

In FIG. 1B, 13 shows a block-like shapd layered element comprising a number of piezoelectric device substrates 5 and first sealing substrates 14 each layered alternately. The piezoelectric device substrate 5, as seen in FIG. 1B, comprises a plurality of piezoelectric devices 5A which include piezoelectric substrates 2 provided at both of their major surfaces with a respective pair of electrodes, the devices 5A being arranged side by side. A plurality of the piezoelectric device substrates 5 are alternated with a plurality of first sealing substrates 14 made of ceramics so that the substrates 5 are adhered at their major surfaces to the plurality of first sealing substrates 14 and form a vibration cavity 9 adjacent the vibrating electrodes 3 of the piezoelectric device 5A, thereby providing the layered element 13 comprising layers of the piezoelectric device substrates 5 alternating with layers of the first sealing substrates 14. Each first sealing substrate 14 is adhered to the piezoelectric device substrate 5 at its rear major surface by an adhesive layer 10. Similarly, the piezoelectric device substrate 5 and the first sealing substrates 14 are alternately layered and adhered to each other to form a substrate-layered element 13 in a block-like shape as shown in FIG. 1B.

In the substrate-layered element 13, the first sealing substrate 14 has been previously recessed at its inner surface at a position corresponding to the portion of the vibrating electrodes 3 of the piezoelectric device substrate 5 so as to have a groove 15 larger in width than the vibrating electrodes 3 and extending over the whole length of the first sealing substrate 14, so that there is provided a vibration cavity 9 having height corresponding to the depth of the previously provided groove 15 plus the thickness of the applied adhesive 10. The vibrating electrodes 3 are formed on the substrate 2 and are located in the vibration cavity 9 (FIG. 2) by placing the first sealing substrate 14 over the substrate 2 with a spacing therebetween. The block-like shaped substrate-layered element 13 is then cut at the lines C—C in FIG. 1B to form a flat substrate-layered element 11 in unit width including a plurality of resonator elements 12 as shown in FIG. 1C.

Then, a draw-out electrode is formed at the end surface of the substrate-layered element 11 by printing or coating silver paste, or a like manner.

Next, a large second sealing substrate 8 is adhered to both lateral side surfaces of the substrate-layered element 11 in the following manner. An adhesive is coated on the upper surface of the large second sealing substrate 8, and then a number of flat substrate-layered elements 11 are placed in a row on the adhesive with their side surfaces being faced downward. Then a second sealing substrate 8 is coated with adhesive and placed on the upward-facing side surfaces of the substrate-layered element 11. In this case, a gap is formed along the lateral side surfaces of the vibrating electrodes 3, not by cutting the side surfaces, but rather by use of a layer of adhesive adhering between each lateral side surface near the vibrating electrode 3 and the second sealing substrate 8 to ensure a gap therebetween. Also, the second sealing substrate 8 may be recessed to have a groove for forming a gap along the lateral side surface near the vibrating electrode 3, thereby ensuring the gap.

Figure 1C:
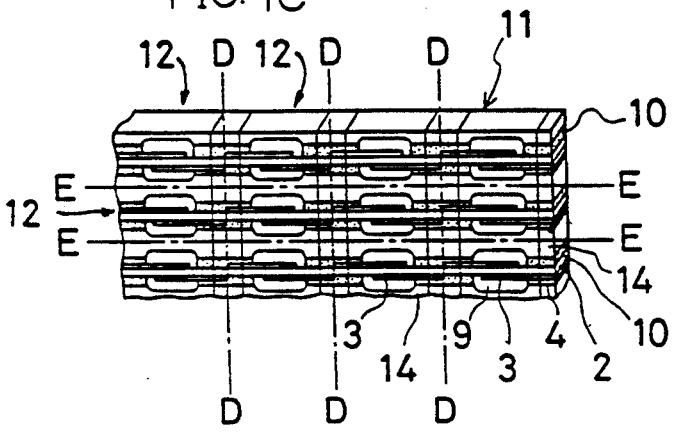
Figure 2:
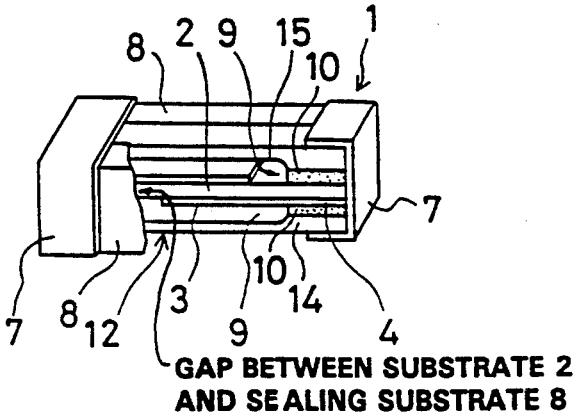
FIG. 2 is a partially sectional perspective view of an example of a piezoelectric resonator manufactured according to the manufacturing method of the present invention.
Figure 3:
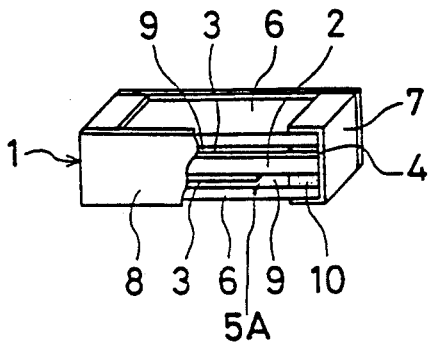
FIG. 3 PRIOR ART
FIG. 3 is a partially sectional perspective view of a known type of piezoelectric resonator.
Figure 4A:
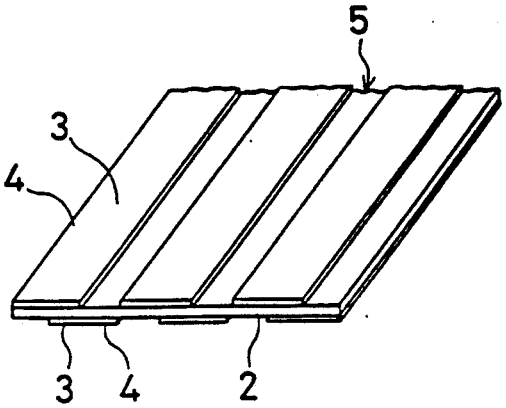
FIG. 4A PRIOR ART
FIGS. 4A and 4B are perspective views showing a manufacturing process of the piezoelectric resonator of FIG. 3.
Figure 4B:
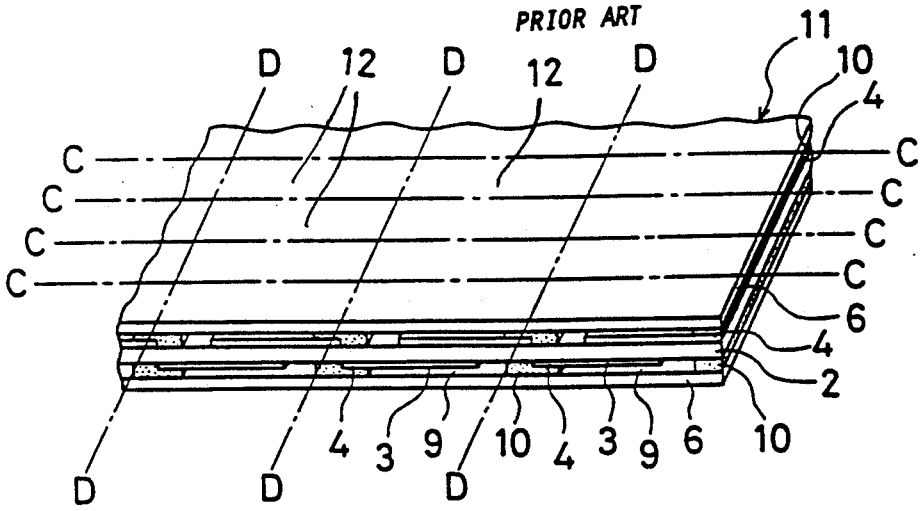
FIG. 4B PRIOR ART

After hardening the adhesive, the device is cut on the lines D—D and E—E in FIG. 1C by use of a cutter blade or a laser, or the like, to form a single resonator element or a plurality of resonator elements 12 with a preferable mass-productivity thanks to use of the large second sealing substrate, in that a single second sealing substrate 8 is usable to seal together a plurality of substrate layered elements 11, as explained above.

Then, the outside electrodes 7 are provided at the end surfaces of the resonator elements 12 (the end surfaces through which the input/output electrodes 4 provided in the piezoelectric devices 54 are exposed to the outside) by first sand blasting, grinding or a like process to reliably expose the end portions of the input/output electrode 4, followed by monel sputtering and galvanizing the same.

The first and second sealing substrates may be hard or soft ones, such as heat resisting film, ceramic plates, ceramic sheet or the like. The vibration cavities 9 surrounding the vibrating electrodes 3 are securely sealed by the sealing adhesive 10 and the second sealing substrate 8.

The course of manufacturing process as above may be changed as or when required by first cutting the flat shaped substrate-layered element 11 to obtain a desired resonator element 12 and then forming a required gap adjacent the piezoelectric substrate 2 by sand blasting, grinding, etching or the like process so as to provide the vibration cavities 9. The input/output electrodes are exposed at the ends of the element and the outside electrodes 7 are adhered thereto. The second sealing substrate 8 is adhered to the lateral sides of the element. This course of process also adopts the block-like shaped substrate-layered element, so that although it requires the same amount of working for laminating, adhering and cutting processes as in the first-cited course of manufacturing process, this can reduce times of repetition of the series of laminating, adhering and cutting processes to improve mass-productivity.

The piezoelectric device substrate may employ a plurality of pairs of vibrating electrodes on the front and rear major surfaces to obtain the same effect as in the above-identified example, and formation of the gap along the vibrating electrode portion may be adjusted by adjusting the specific thickness of the applied adhesive.

The present invention should not be limited in scope to the above examples but may be properly modified within the fair spirit and scope of the invention.

EFFECT OF THE INVENTION

As seen from the above, the method of manufacturing a piezoelectric resonator according to the present invention can further improve work efficiency and mass-productivity and reduce cost to produce in comparison with the conventional techniques.

What is claimed is:

1. A method of manufacturing a piezoelectric resonator comprising the steps of:

a) laminating and adhering a piezoelectric device substrate, which is provided with a plurality of vibrating electrodes and input/output electrodes, at one major surface of the piezoelectric device substrate to a first sealing substrate, so as to form a vibration cavity surrounding the vibrating electrodes, and then laminating and adhering another first sealing substrate to the other major surface of the piezoelectric device substrate to further form the vibration cavity surrounding the vibrating electrodes;

b) continuing the foregoing laminating and adhering steps a selected number of times to make a plurality of such alternating laminated and adhered piezoelectric device substrates and first sealing substrates so as to form a block-like layered element;

c) cutting the block-like layered element along a predetermined plane to form a flat substrate-layered element; and d) cutting the flat substrate-layered element along two predetermined planes to provide a single resonator element.

2. A method of manufacturing a piezoelectric resonator as set forth in claim 1, wherein after forming the flat substrate-layered element, and cutting the flat substrate-layered element to obtain the single resonator element, a second sealing substrate is adhered to both lateral side surfaces of the resonator element with a gap formed between the second sealing substrate and to the vibrating electrodes, and outside electrodes which electrically communicate with the input/output electrodes are formed at the ends of the resonator element.

3. A method of manufacturing a piezoelectric resonator set forth in claim 1, wherein a gap is formed between the side surfaces of the vibrating electrodes and the second sealing substrates by adhesive layers between the second sealing substrates and both side surfaces of the resonator element.

4. A method of manufacturing a piezoelectric resonator as set forth in claim 3, wherein said gap is further formed at least in part by forming a recess in the second sealing substrate prior to adhering the second sealing substrate to the resonator element.

5. A method of manufacturing a piezoelectric resonator as set forth in claim 1, further comprising the step of adhering second sealing substrates to both lateral side surfaces of the flat substrate-layered element.

6. A method of manufacturing a piezoelectric resonator as set forth in claim 5, further comprising the step of forming outside electrodes which electrically communicate with the input/output electrodes at both end surfaces of the flat substrate-layered element.

7. A method of manufacturing a piezoelectric resonator as set forth in claim 1, further comprising the step of adhering second sealing substrates to both lateral side surfaces of the single resonator element.

8. A method of manufacturing a piezoelectric resonator as set forth in claim 7, further comprising the step of forming outside electrodes, which electrically communicate with the input/output electrodes at both end surfaces of the single resonator element.

9. A method of manufacturing a piezoelectric resonator as set forth in claim 1, wherein said vibration cavity is formed at least in part by forming a recess in each first sealing substrate before laminating and adhering said substrate to said piezoelectric device substrate.

10. A method of manufacturing a piezoelectric resonator as set forth in claim 1, wherein said vibration cavity is formed at least in part by forming a recess in each first sealing substrate before laminating and adhering said substrate to said piezoelectric device substrate and further comprising the step of forming each said outside electrode at a side surface of the flat substrate-layered element where the input/output electrodes are exposed to the exterior.

11. A method of manufacturing a piezoelectric resonator comprising the steps of:

a) laminating and adhering a piezoelectric device substrate, which is provided at one major surface of the piezoelectric device substrate with a plurality of vibrating electrodes and input/output electrodes, to a first sealing substrate, so as to form a vibration cavity surrounding the vibrating electrodes, laminating and adhering another first sealing substrate to the other major surface of the piezoelectric device substrate to further form the vibration cavity;

b) continuing the foregoing laminating and adhering steps a selected number of times to make a plurality of such alternating laminated and adhered piezoelectric device substrates and first sealing substrates so as to form a block-like layered element;

c) cutting the block-like layered element along a predetermined plane to form a flat substrate-layered element; and d) forming a gap in the resonator element adjacent the vibrating electrodes by sandblasting, grinding or etching;

e) then adhering a second sealing substrate to both sides of the flat substrate-layered element;

f) then cutting the substrate-layered element so as to form a single resonator element; and g) thereafter forming outside electrodes which electrically communicate with the input/output electrodes at the ends of the resonator element.

* * * * *